US009220973B1

(12) United States Patent
Stringer

(10) Patent No.: US 9,220,973 B1
(45) Date of Patent: Dec. 29, 2015

(54) EDUCATIONAL BOARD GAME

(71) Applicant: Jennifer K. Stringer, Hattiesburg, MS (US)

(72) Inventor: Jennifer K. Stringer, Hattiesburg, MS (US)

( * ) Notice: Subject to any disclaimer, the term of this patent is extended or adjusted under 35 U.S.C. 154(b) by 0 days.

(21) Appl. No.: 14/246,623

(22) Filed: Apr. 7, 2014

(51) Int. Cl.
*A63F 3/00* (2006.01)
*A63F 9/18* (2006.01)

(52) U.S. Cl.
CPC ..... *A63F 3/00006* (2013.01); *A63F 9/18* (2013.01)

(58) Field of Classification Search
CPC ..... A63F 3/0006; A63F 9/18; A63F 9/02; A63F 7/066; A63F 7/09; A63F 7/0406; A63F 7/2472; A63F 9/0079; A63F 9/208; A63F 9/0406; A63F 9/2472; A63F 9/04; A63H 27/14; A63H 27/005; A63H 13/02; A63H 13/10; A63H 17/00; A63H 17/006; A63H 17/008; A63H 27/00; A63H 27/06; A63H 29/16; A63H 33/00; A63H 33/28; A63H 3/005
USPC ..... 273/145 R, 145 B, 249
See application file for complete search history.

(56) References Cited

U.S. PATENT DOCUMENTS

| | | | | | |
|---|---|---|---|---|---|
| 476,963 | A * | 6/1892 | Oscar Kind | ..... | 126/170 |
| 2,657,057 | A * | 10/1953 | Chapin | ..... | 273/357 |
| 5,092,606 | A * | 3/1992 | Miller | ..... | 273/249 |
| 5,224,710 | A * | 7/1993 | Feokhari | ..... | 273/247 |
| 5,246,373 | A | 9/1993 | Becker | | |
| 5,273,431 | A | 12/1993 | Charouhas | | |
| 5,471,968 | A * | 12/1995 | Lee | ..... | 124/64 |
| 5,516,290 | A | 5/1996 | Quigley et al. | | |
| 6,206,371 | B1 * | 3/2001 | Dove | ..... | 273/144 R |
| 6,279,908 | B1 * | 8/2001 | Hunsberger | ..... | 273/249 |
| 6,447,300 | B1 | 9/2002 | Greenberg | | |
| 6,910,893 | B2 | 6/2005 | Dillhoff | | |
| 7,874,892 | B2 * | 1/2011 | Hippely | ..... | 446/429 |

* cited by examiner

*Primary Examiner* — Vishu Mendiratta
(74) *Attorney, Agent, or Firm* — Robert C. Montgomery; Montgomery Patent & Design, LLC

(57) ABSTRACT

An educational board game includes a playing board, a plurality of cards, a die and a die launcher. The playing cards are separated into categories and the die has a plurality of colored faces, each color corresponding to a particular category. The die is placed on the launcher and a bellows-type pedal is depressed, thereby launching the die. The color displayed by the die represents the category of card to be taken. Each card has a challenge question or task disposed thereon which a user has to answer or perform. If the user answers the question correctly a game piece is moved on the playing board. The first game piece to advance through the playing board is the winner.

18 Claims, 6 Drawing Sheets

EDUCATIONAL BOARD GAME

RELATED APPLICATIONS

None

FIELD OF THE INVENTION

The present invention relates to an educational multi-player board-based game especially suited to preschool children players that utilizes a playing board, a plurality of cards, a die and a die launcher.

BACKGROUND OF THE INVENTION

During the educational process of a child, it is often necessary to determine how a child is performing in relation to his or her peers, and/or to determine if he or she is ready for school, or the next step in their educational process. Such benchmarking processes are often a one on one process with an adult/teacher which can be scary for the child, causing inaccurate results. While games can be adapted to determine such benchmarking levels, the randomness of the game can also cause errors. Additionally, children may react better in a group environment rather than individually, which most typical games do not excel at. Accordingly, there exists a need for a means by which a child's game can be developed which is not only fun to play, but aids in determining learning benchmarks as well.

SUMMARY OF THE INVENTION

The disadvantages of the prior art are overcome by the present invention in providing an educational multi-player board-based game especially suited to preschool children players comprises a playing board, a plurality of cards, a die and a die launcher. The game can also be used to establish general knowledge benchmarks of the players. The game utilizes a game board assembly that facilitates a question and answer process within various subjects. The die is placed on the launcher and a pedal is depressed launching the die. The color displayed by the die represents the category of card to choose from. Each card has a question disposed thereon which a user has to answer. If the user answers the question correctly a game piece is moved on the playing board. The first game piece to advance through the playing board is the winner.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
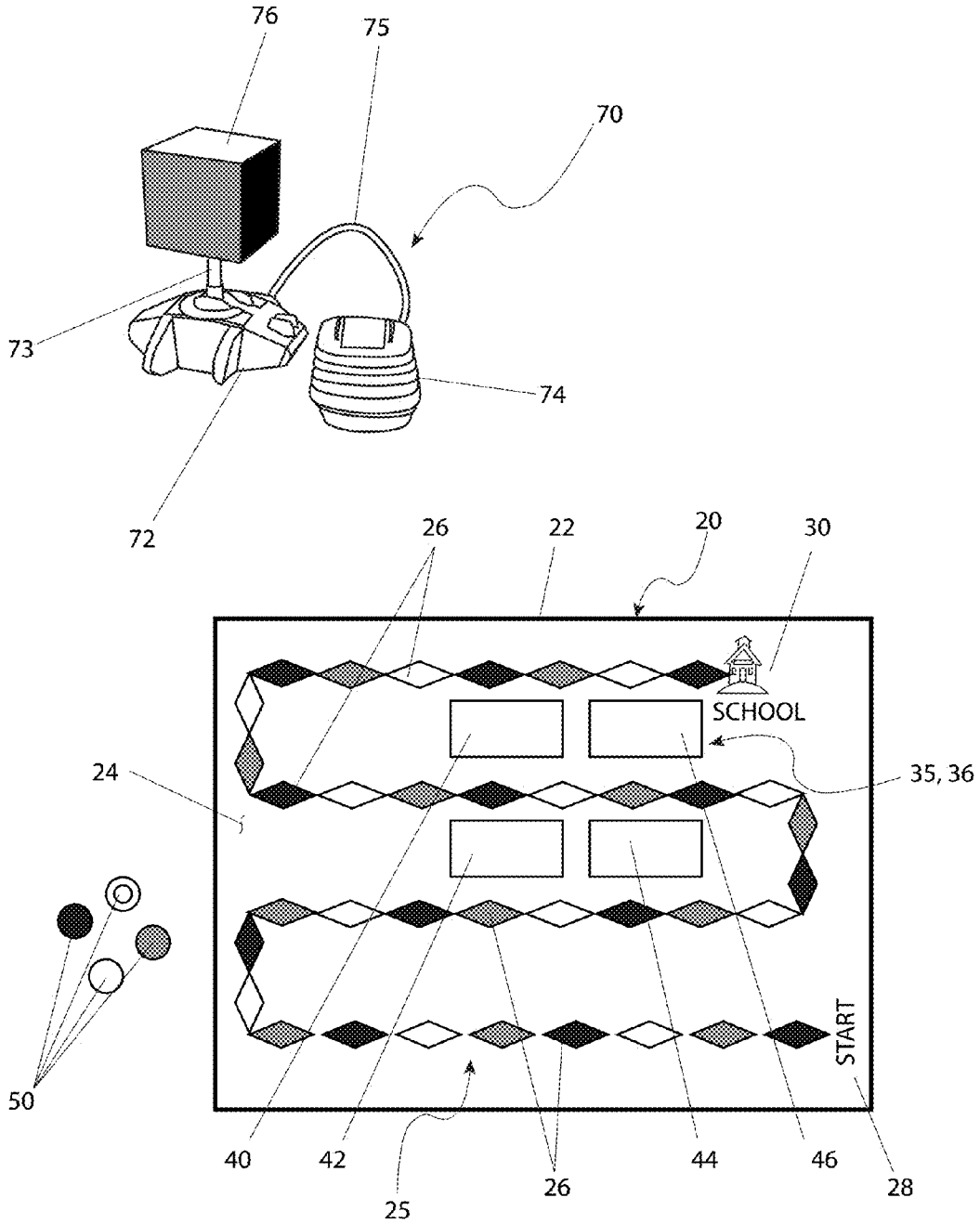
FIG. 1 is an exploded view of an educational board game 10, according to a preferred embodiment of the present invention.

10 educational board game
20 game board assembly
22 board
24 playing surface
25 game path
26 game steps
28 starting point
30 ending point
35 card deck
36 challenge question cards
40 language card set
40*a* first language card
40*b* second language card
42 letter identification card set
42*a* first letter identification card
42*b* second letter identification card
44 logic card set
44*a* first logic card
44*b* second logic card
46 physical card set
46*a* first physical card
46*b* second physical card
50 game token set
70 path advance device
72 base
73 mounting tube
74 bellows
75 air hose
76 die
78 aperture
100 player

DETAILED DESCRIPTION OF THE PREFERRED EMBODIMENT

The best mode for carrying out the invention is presented in terms of its preferred embodiment, herein depicted within FIGS. 1 through 6*b*. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an educational board game (herein described as the "game") 10, which provides an educational multi-player board-based game especially suited to preschool children players 100. It is envisioned that the game 10 can also be used to establish general knowledge benchmarks of the players 100. The game 10 utilizes a game board assembly 20 which facilitates a question and answer process of various subjects. Generally speaking, the player 100 moves a token forward along the game increments or steps, lands on a step with a correspondingly categorized challenge question card, advances with a correct answer, and competes with the other players to finish first.

Referring now to FIG. 1, an exploded view of the game 10, according to a preferred embodiment of the present invention, is disclosed. The game 10 comprises a game board assembly 20, a card deck 35 that includes a plurality of question or challenge cards 36 that are organized into different categories or sets 40, 42, 44, and 46, a set of player tokens 50, and a path advance device 70. The game board assembly 20 comprises a conventional rectangular pressed paper game board 22, being printed upon one (1) side with a serpentine path of a plurality of geometric game increments or steps 26 having a starting point 28 and an ending point 30. The game steps 26 are envisioned to comprise sequentially arranged geometric shapes such as diamonds, squares, and the like, which form a route from the starting point 28 to an ending point 30. The geometric shapes of the steps 26 additionally have a specific color assigned to them that relates to the categories of the challenge cards 36. It is envisioned that the game path 25 is arranged in a serpentine pattern over the board 22 with sufficient space along the path of game steps 26 for placement of stacks of the card sets 40, 42, 44, and 46. It is further envisioned that the board 22 provides at least one (1) folding feature allowing for folding for compact storage.

In the preferred embodiment, the deck 35 of challenge question cards 36 present various questions to the players 100 and are organized and separated into four (4) different categories or subjects 40, 42, 44, and 46. It should be appreciated that the categories are not limited to only four (4) and may be of any number based on the desired complexity and difficulty desired by the game producer. Of the deck 35 illustrated herein, a question or challenge is printed upon the obverse or face side of the card 36 and a solid color corresponding to the categories established is printed upon the reverse side. The game 10 is illustrated here having four (4) categories of card sets 40, 42, 44, and 46 within the deck 35. As an example, a language card set 40 (see FIGS. 3*a* and 3*b*) is designated by the color blue, a letter identification card set 42 (see FIGS. 4*a* and 4*b*) is designated by the color white, a logic card set 44 (see FIGS. 5*a* and 5*b*) designated as red, and a physical card set 46 (see FIGS. 6*a* and 6*b*) designated as yellow. Again, it should be understood that the game 10 may comprise various types and numbers of categories and corresponding question cards without deviating from the teachings of the invention 10, and as such this example should not be interpreted as a limiting factor of the game 10.

At beginning of play, the players 100 start with their tokens 50 on the starting point 28 and move, in turn, along the serpentine game path 25. The move of the token 50 is to the next colored step 26 along the path 25 that corresponds to the color revealed by the path advance device 70. In landing on a game step 26, it is determined which card category that particular step 26 represents, and the player 100 draws a corresponding card 36 from the respective stack of categorized cards 40, 42, 44, and 46. The player 100 then attempts to correctly answer the question or performs the task printed upon the card 40, 42, 44, and 46. If successful, the player advances their game token 50 to the next game step 26 of that color. If unsuccessful, the turn is over and play proceeds to the next player 100. The player 100 that first reaches the ending point 30 wins. In addition to the educational enhancement and game playing skills developed in the use of the present invention, it is also envisioned to provide a means to benchmark a child's individual skill level.

Figure 2:
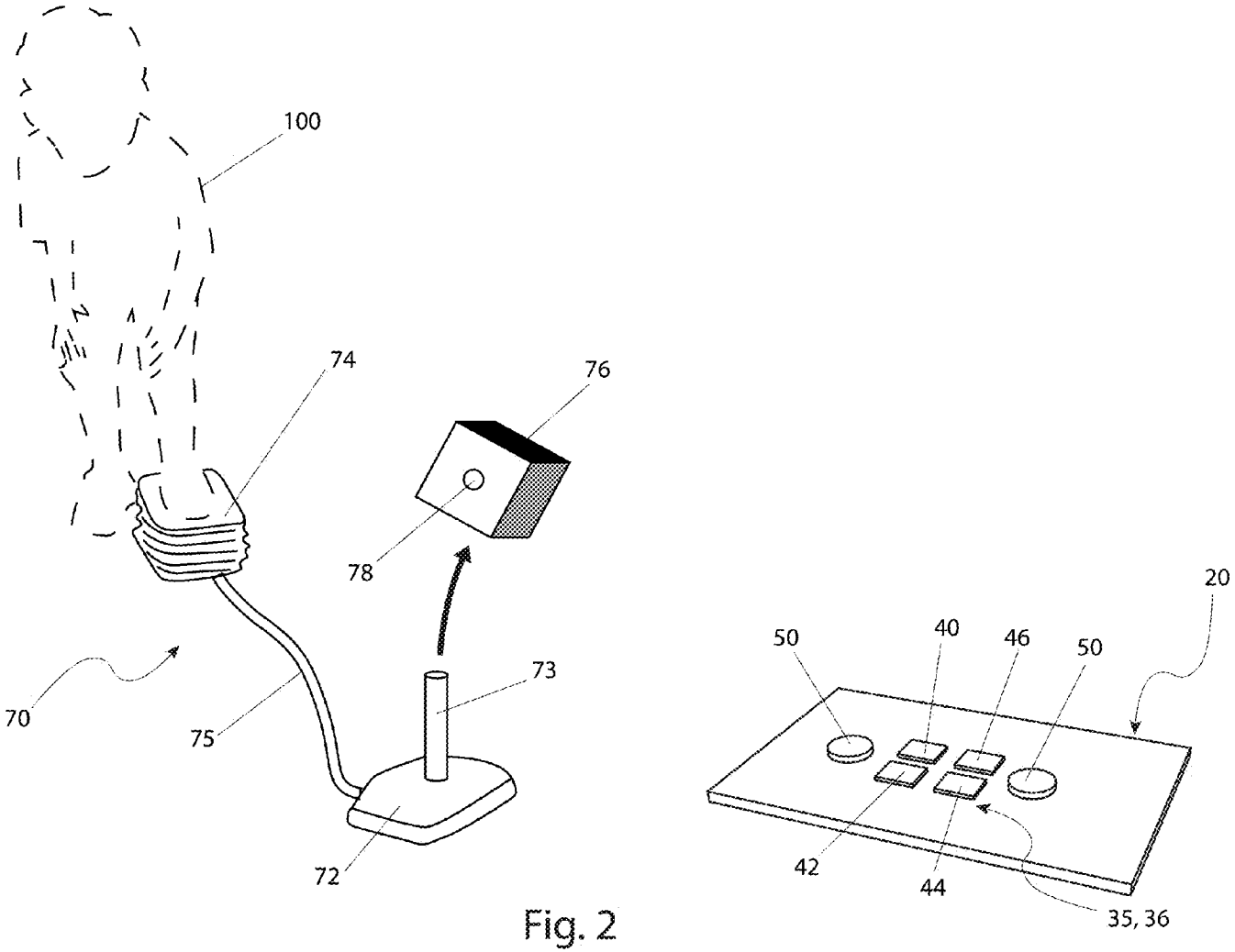
FIG. 2 is an environmental view of the educational board game 10, according to a preferred embodiment of the present invention.

Referring now to FIG. 2, an environmental view of the game 10, according to a preferred embodiment of the present invention, is disclosed. During game play, a specific path advance device 70 is utilized to provide the players 100 with entertaining manner of determining to which game steps 26 the players 100 are allowed to move in turn. More specifically, in the preferred embodiment, the path advance device 70 is a pneumatic launcher that comprises a large scale, lightweight cube-shaped die 76 that is launched into the air. The pneumatic launcher 70 is envisioned to be similar to products sold by the SPIN MASTER CO.® comprising a base 72 having an integral upwardly directed mounting tube 73 and a foot-actuated bellows 74. An air hose 75 connects the bellows 74 to the base 72 and provides pneumatic communication between the two (2). The path advance device 70 includes a die 76. Rather than convention pips on the side of the die 76 representing numbers, the die of the present invention has colored sides that relate to the categories determined in the card deck 35. The randomly colored cubical die 76 is launched as a projectile by player 100 who steps upon the bellows portion 74 which in turn provides a flow of air through the air hose 75 and mounting tube 73 portions. Formed into one (1) side of the die 76 is an aperture and bore 78 that corresponds to the upwardly directed mounting tube 73 of the launcher 70. To prepare the die 76 for launch, its aperture 78 is placed down upon the mounting tube 73 of the launcher 70. The a blast of air from the bellows 74 propels the die 76 upwardly from the mounting tube 73 causing it to become airborne and subsequently return to the floor surface where it rolls and comes to rest. Based upon the resulting color displayed upon the upper surface of the die 76, a player 100 moves the token 50 to the selects and responds to a correspondingly colored card 40, 42, 44, and 46.

It should be noted, in the present example, the cube-shaped die 76 has six (6) sides and only four (4) categories of challenge question are used for illustration. In this case, the two (2) sides of the cube that are available beyond the four (4) used to specifically color relate to the challenge categories, may be used as a "wild card" or "free space" in which the player is allowed to choose the next game step and corresponding challenge category. Likewise, if it is desirable to have more than six (6) challenge categories, another geometric shape having greater than six (6) sides may be substituted for the cube shaped die 76.

The game token set 50 comprises a plurality of unique game pieces being illustrated here as molded plastic or metal disc-shaped poker chip-like pieces having different colors to be used by respective players 100 to mark their progress during participation in the game 10. However, it should be understood that the game token set 50 may be introduced having various other visual appearances including themes such as animals, pets, miscellaneous household objects, and the like, with equal benefit and, as such, should not be interpreted as a limiting factor of the game 10.

Figure 3A:
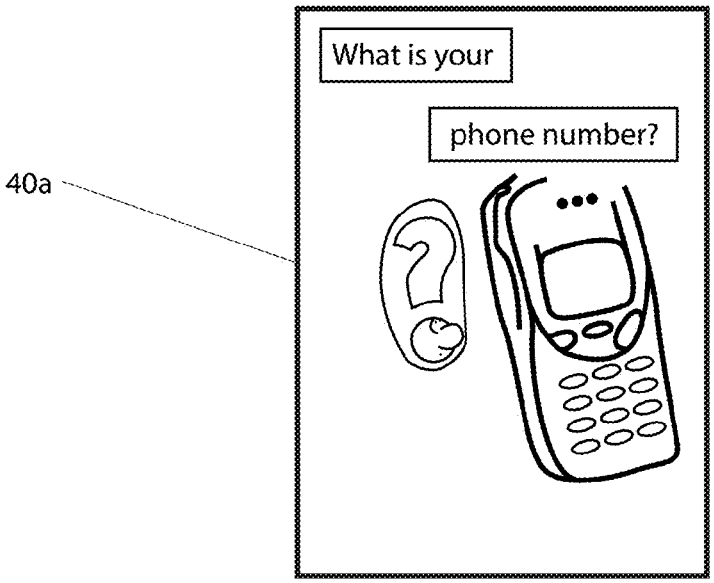
FIG. 3*a* is a top view of a first language card portion 40*a* of the educational board game 10, according to a preferred embodiment of the present invention.
Figure 3B:
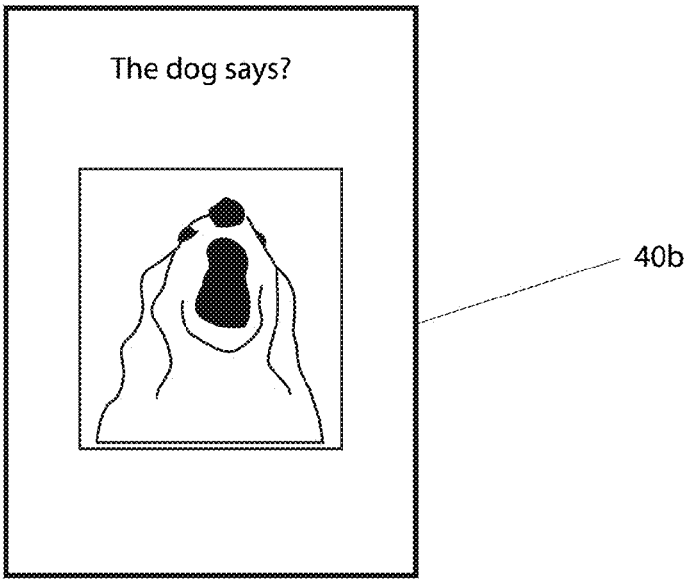
FIG. 3*b* is a top view of a second language card portion 40*b* of the educational board game 10, according to a preferred embodiment of the present invention.

Referring now to FIGS. 3*a* through 6*b*, the challenge question cards 36 are disclosed. The categories of challenge may include physical acts, mental calculations, logical analysis, and factual recall or the like. In the preferred embodiment, they are defined by language, letter identification, logic, and physical challenges. As shown in FIGS. 3*a* and 3*b*, top views of first language card 40*a* and second language card 40*b* portions of the game 10, according to a preferred embodiment of the present invention, are disclosed. The first language card 40*a* and second language card 40*b* depict examples of language questions by utilizing pictures, text, and the like to communicate the question and answer process; however, it is understood that any number of language questions may be introduced being illustrated in a similar manner to these examples to improve a player's 100 language skills while playing the game 10.

Figure 4A:
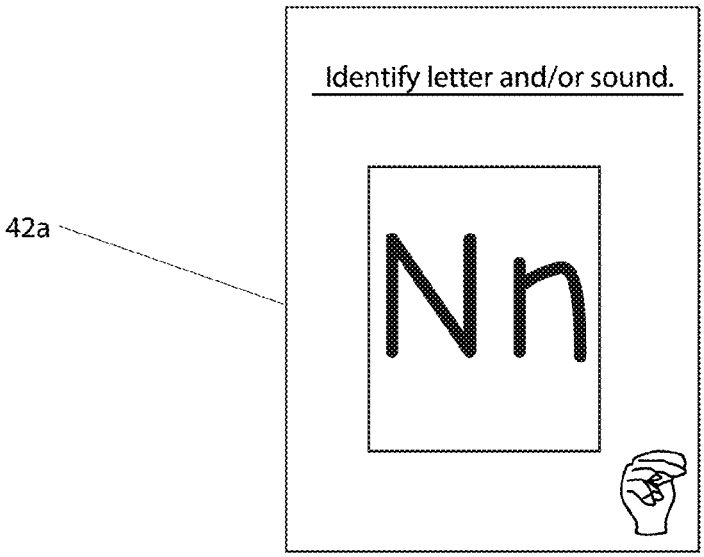
FIG. 4*a* is a top view of a first letter identification card portion 42*a* of the educational board game 10, according to a preferred embodiment of the present invention.
Figure 4B:
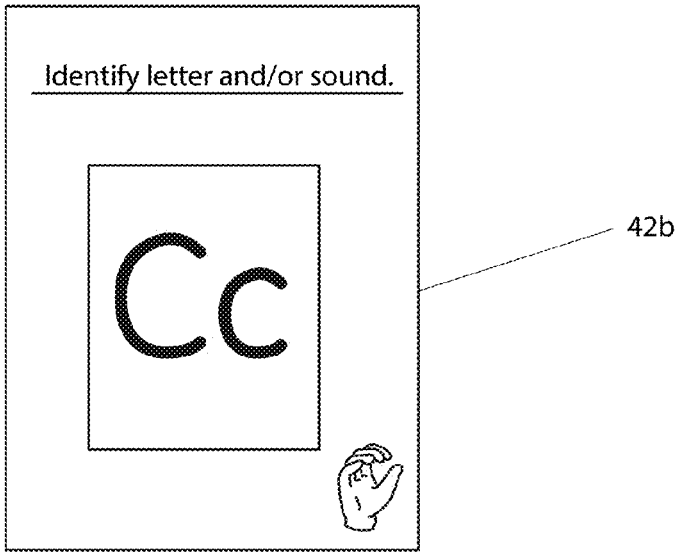
FIG. 4*b* is a top view of a second letter identification card portion 42*b* of the educational board game 10, according to a preferred embodiment of the present invention.

Referring now to FIGS. 4*a* and 4*b*, top views of first letter identification card 42*a* and second letter identification card 42*b* portions of the game 10, according to a preferred embodiment of the present invention, are disclosed. The first letter identification card 42*a* and second letter identification card 42*b* depict examples of letter identification questions by utilizing pictures, text, and the like; however, it is understood that any number of letter identification questions may be introduced being illustrated in a similar manner to these examples improve a player's 100 letter identification skills while playing the game 10.

Figure 5A:
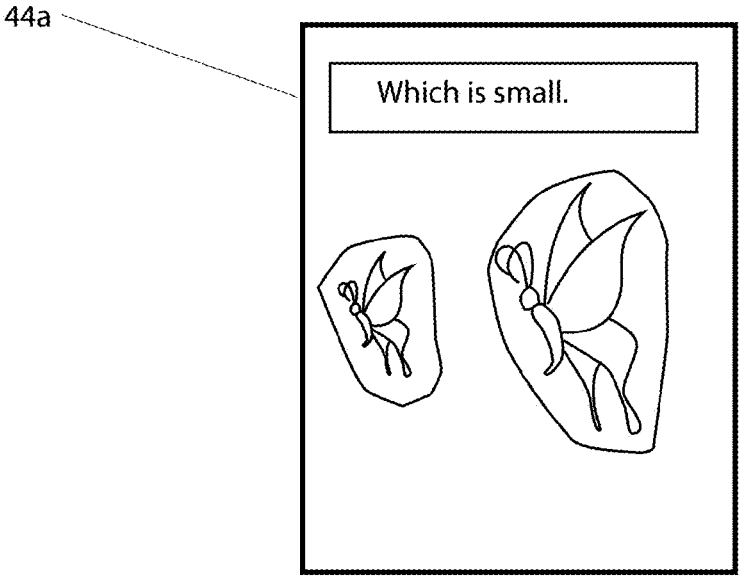
FIG. 5*a* is a top view of a first logic card portion 44*a* of the educational board game 10, according to a preferred embodiment of the present invention.
Figure 5B:
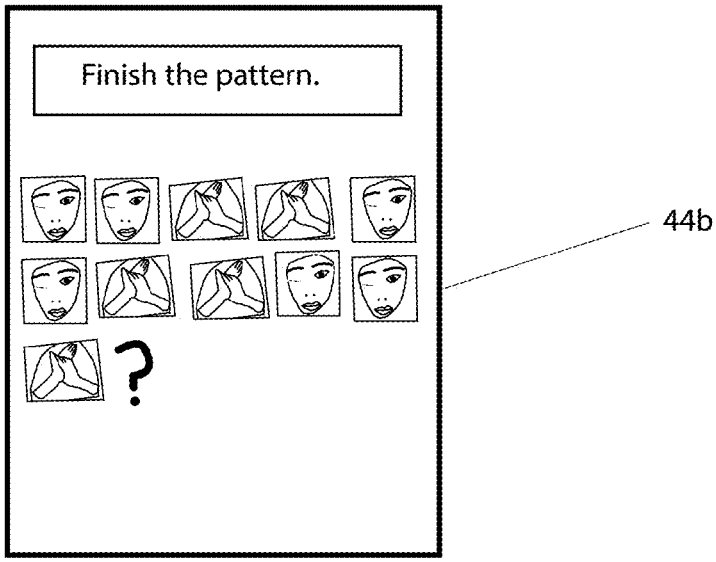
FIG. 5*b* is a top view of a second logic card portion 44*b* of the educational board game 10, according to a preferred embodiment of the present invention.

Referring now to FIGS. 5*a* and 5*b*, top views of first logic card 44*a* and second logic card 44*b* portions of the game 10, according to a preferred embodiment of the present invention, are disclosed. The first logic card 44*a* and second logic card 44*b* depict examples of logic questions by utilizing pictures, text, and the like; however, it is understood that any number of logic questions may be introduced being illustrated in a similar manner to these examples to improve a player's 100 logic skills while playing the game 10.

Figure 6A:
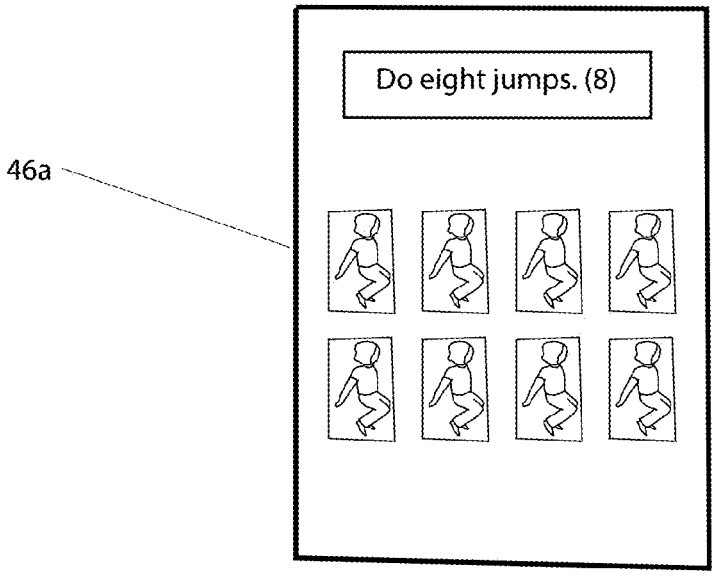
FIG. 6*a* is a top view of a first physical card portion 46*a* of the educational board game 10, according to a preferred embodiment of the present invention; and, FIG. 6*b* is a top view of a second physical card portion 46*b* of the educational board game 10, according to a preferred embodiment of the present invention.
Figure 6B:
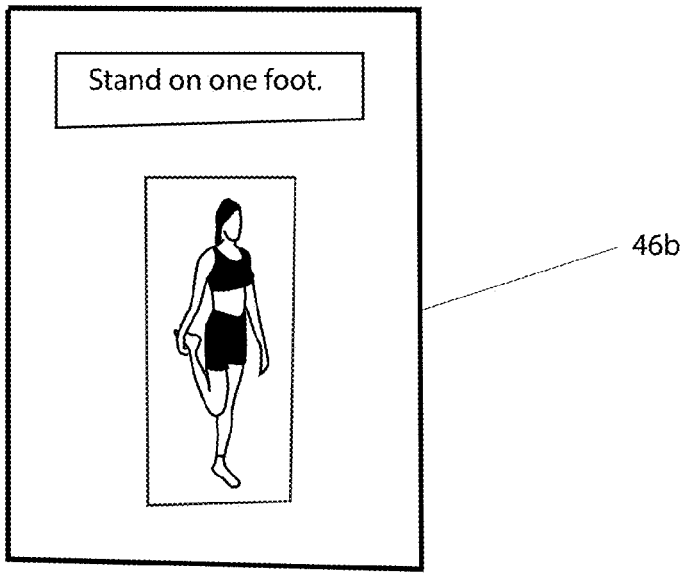

Referring now to FIGS. 6*a* and 6*b*, top views of first physical card 46*a* and second physical card 46*b* portions of the game 10, according to a preferred embodiment of the present invention, are disclosed. The first physical card 46*a* and second physical card 46*b* depict examples of physical questions by utilizing pictures, text, and the like; however, it is understood that any number of physical questions may be introduced being illustrated in a similar manner to these examples to improve a player's 100 physical skills while playing the game 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the game 10, it would be installed and utilized as indicated in FIGS. 1 and 2.

The method of utilizing the game 10 may be achieved by performing the following steps: procuring a model of the game 10 comprising desired numbers of and types of categories; unfolding and placing the board 22 onto a flat surface such as a table; placing the card sets 40, 42, 44, and 46 upon the board 22 at appropriate locations; placing the game tokens 50 at a starting point portion 28 of the board 22; selecting a player 100 to roll the die 76 by stepping upon the bellows portion 74 of the pneumatic launcher 70 to motion the die 76; observing a color of an upwardly-facing side of the die 76 upon coming to rest; selecting a card from a correspondingly colored card set 40, 42, 44, 46. reading the question printed upon the card 40, 42, 44, 46; correctly answering the question or performing the task printed upon the card 40, 42, 44, 46; advancing the player's 100 game token 50 to the next game step 26 having that color; repeating the above steps for the remaining players 100; continuing the rolling of the die 76 and moving of the game tokens 50 for all players 100 until a player 100 reaches the ending point 30 to win the game 10. The game 10 provides a fun and entertaining board game for groups of children players 100, but also allows for easy benchmarking of the child's individual skill level.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An educational board game comprising:

a game board illustrated with a game path;

a deck of individual challenge cards organized into a plurality of challenge categories;

a plurality of player tokens, each assigned to a specific player; and, a path advance device adapted to generate moves along said game path for each of said multiple players, further comprising:

a base capable of positioning a mounting tube in a vertically upstanding position and perpendicular from a surface said base independently rests upon; and, a foot-actuated bellows in fluid communication with said base;

a cube-shaped projectile, colored with a different color on each face, each color corresponding to one of said plurality of challenge categories, further having an aperture located on one face and a bore extending within said projectile;

wherein said bore of said projectile is capable of being placed onto said mounting tube in order to be launched by said path advance device;

wherein said player advances said assigned token along said path, in turn, in response to said path advance device;

wherein said player must draw one of said challenge cards from said deck that corresponds to an individual challenge category indicted by location along said game path where said token lands; and, wherein said player is required to perform a stated challenge as indicated by said drawn challenge card.

2. The educational board game of claim 1, wherein said game path is further illustrated as a serpentine path having a plurality of geometric game steps with a starting point and an ending point with a plurality of steps therebetween.

3. The educational board game of claim 2, wherein each of said plurality of challenge categories is assigned a particular color and each of said plurality of geometric game steps is colored to correspond thereto.

4. The educational board game of claim 1, wherein said deck of individual challenge cards is further organized into a plurality of sets, each said set defined by one of said plurality of challenge categories.

5. The educational board game of claim 1, wherein said player advances said assigned token along said path, in turn, to the next said game step that corresponds to the color displayed on said projectile.

6. The educational board game of claim 1, wherein said plurality of challenge are at least defined by physical acts, mental calculations, logical analysis, and factual recall.

7. The educational board game of claim 1, wherein said challenge cards are categorized by language, letter identification, logic, and physical challenges.

8. The educational board game of claim 7, wherein said challenge cards utilizes at least one or a combination of pictures, text, and words to communicate the challenge question.

9. An educational board game for comprising:

a game board illustrated with a game path having a start and an end point with a plurality of steps therebetween;

a deck of individual challenge cards organized into a plurality of sets, each defined by one of a plurality of challenge categories;

a plurality of player tokens, each assigned to a specific player; and, a path advance device adapted to generate a random color, further comprising:

a base capable of positioning a mounting tube in a vertically upstanding position and perpendicular from a surface said base independently rests upon; and, a foot-actuated bellows in fluid communication with said base;

a projectile having a plurality of faces, colored with a different color on each face, each color corresponding to one of said plurality of challenge categories, further having an aperture located on one face and a bore extending within said projectile;

wherein each of said plurality of said steps on said game board has a color that corresponds to one of said plurality of categories of challenge cards;

wherein said bore of said projectile is capable of being placed onto said mounting tube in order to be launched by said path advance device;

wherein said player advances said assigned token along said steps of said game path, in turn, in response to a color generated by said path advance device;

wherein said player must draw one of said plurality of challenge cards that corresponds to an individual challenge category indicted on a step of said board where said token lands; and, wherein said player is required to perform one of any of a variety of challenges as indicated by said drawn challenge card.

10. The educational board game of claim 9, wherein said game path is further illustrated as a serpentine path and said plurality of steps are geometric shapes.

11. The educational board game of claim 10, wherein each of said plurality of challenge categories is assigned a particular color and each of said plurality of geometric game steps is colored to correspond thereto.

12. The educational board game of claim 9, wherein said deck of individual challenge cards is further organized into a plurality of sets, each said set defined by one of said plurality of challenge categories.

13. The educational board game of claim 9, wherein said player advances said assigned token along said path, in turn, to the next of said plurality of game steps that corresponds to the color displayed on said projectile.

14. The educational board game of claim 13, wherein said projectile is a geometric shape having greater than six sides.

15. The educational board game of claim 9, wherein said plurality of challenge categories are defined at least by physical acts, mental calculations, logical analysis, and factual recall.

16. The educational board game of claim 9, wherein said challenge cards are categorized by language, letter identification, logic, and physical challenges.

17. The educational board game of claim 9, wherein said challenge cards utilize at least one or a combination of pictures, text, and words to communicate the challenge question.

18. An educational board game comprising:

a game board illustrated with a serpentine game path having a start and an end point with a plurality of steps defined as geometric shapes therebetween;

a deck of individual challenge cards organized into a plurality of sets, each defined by one of a plurality of challenge categories that include language, letter identification, logic, and physical challenges;

a plurality of player tokens, each assigned to a specific player;

a path advance device, further comprising a base capable of positioning a mounting tube in a vertically upstanding position and perpendicular from a surface said base independently rests upon, and a foot-actuated bellows in fluid communication with said base; and, a cube-shaped projectile, colored with a different color on each face, each color corresponding to one of said plurality of challenge categories, further having an aperture located on one face and a bore extending within said projectile;

wherein each of said plurality of said steps on said game board has a color that corresponds to one of said plurality of challenge categories and the faces of said projectile;

wherein said bore of said projectile is capable of being placed onto said mounting tube in order to be launched by said path advance device;

wherein said player advances said assigned token along said steps of said game path, in turn, in response to a color generated by said path advance device;

wherein said player must draw one of said plurality of challenge cards that corresponds to an individual challenge category indicted on a step of said board where said token lands; and, wherein said player is required to perform one of any of a variety of challenges as indicated by said drawn challenge card.

* * * * *